United States Patent [19]

Hussamy

[11] Patent Number: 4,836,828

[45] Date of Patent: Jun. 6, 1989

[54] CONTINUOUS THERMOSOL DYEING OF HIGH-MODULUS, HIGH-TENACITY, LOW-SHRINKAGE POLYAMIDE FABRICS WITH ACID DYES

[75] Inventor: Samir Hussamy, Lynchburg, Va.

[73] Assignee: Burlington Industries, Inc., Greensboro, N.C.

[21] Appl. No.: 124,573

[22] Filed: Nov. 24, 1987

[51] Int. Cl.[4] ..... C09B 67/00

[52] U.S. Cl. ..... 8/594; 8/680; 8/924; 8/933

[58] Field of Search ..... 8/594, 924, 933, 680

[56] References Cited

U.S. PATENT DOCUMENTS

| | | | |
|---|---|---|---|
| 4,077,764 | 3/1978 | von der Eltz et al. | 8/933 |
| 4,180,491 | 12/1979 | Kim et al. | 8/552 |
| 4,406,661 | 9/1983 | Bühler et al. | 8/464 |
| 4,421,516 | 12/1983 | Stahl et al. | 8/464 |
| 4,631,067 | 12/1986 | Hussamy | 8/464 |

*Primary Examiner*—Paul Lieberman
*Assistant Examiner*—Christine Skane
*Attorney, Agent, or Firm*—Nixon & Vanderhye

[57] ABSTRACT

Fabrics constructed of high-modulus, high-tenacity, low-shrinkage polyamide fabrics are continuously dyed with acid dyes by applying at ambient temperatures a pad bath solution formulated to provide a continuous film on the fabric surface followed by drying and dry heat curing or thermosoling at elevated temperatures to fix the dye molecules inside the fibers.

18 Claims, No Drawings

CONTINUOUS THERMOSOL DYEING OF HIGH-MODULUS, HIGH-TENACITY, LOW-SHRINKAGE POLYAMIDE FABRICS WITH ACID DYES

This invention relates to a process for the continuous thermosol dyeing of high-modulus, high-tenacity, low-shrinkage polyamide fabrics with acid dyes.

In particular, the present invention relates to the discovery that certain dye pad formulations and processing conditions enable one to continuously thermosol dye textile fabrics derived from high-modulus, high-tenacity, low-shrinkage polyamide fibers with acid dyestuffs in a very controllable, practical, and efficient manner employing dry heat. The process produces first quality, high-modulus, high-tenacity, low-shrinkage polyamide dyed fabrics to full tinctorial value having good overall fastness properties, especially to light, washing, and crocking without adversely affecting the excellent mechanical properties of these fibers. Disclosed is a continuous dry heat cure or thermosol dyeing process in which acid dyestuffs are utilized in accordance with the process of this invention for the efficient continuous dyeing and the coloration of high-modulus, high-tenacity, low-shrinkage polyamide fabrics.

BACKGROUND AND SUMMARY OF THE INVENTION

High-modulus, high-tenacity, low shrinkage polycarbonamides made by the intermolecular condensation of linear diamines containing from 6 to 10 carbon atoms with the linear dicarboxylic acids containing from 2 to 10 carbon atoms and specifically designed for industrial uses are sold under the trademarks DuPont High Tenacity Nylon (6-6) and Cordura® nylon in which the filaments have been texturized and bulked becoming disarranged, looped and tangled within the bundle to give the Cordura yarn a degree of bulk equal to that of spun yarns. Fabrics made of these yarns are stable against light and heat, have low dry heat shrinkage (3%), are fatigue resistant with good adhesion properties, have high-tenacity with outstanding toughness and resistance to degradation, and are designed for specific industrial uses such as coated fabrics, protective fabrics, sewing threads, tapes, backpacks, boots, camera bags, golf bags, hand bags, horse blankets, hunting apparel and gear, indoor/outdoor furniture, luggage, shoes, protective covers, ski covers/boot bags, sportbags/-totes/duffles, upholstery, video/computer bags, wallets, and apparel.

A serious problem limiting the commercial exploitation of these high-modulus, high-tenacity, low-shrinkage polyamide fibers has been the fact that fabrics made of these fibers are difficult to efficiently and economically dye in practice and produce level dyed fabrics with good overall fastness properties especially to light and washing. Initially, these polyamide fabrics have been dyed in dyeing machines such as jigs, beams, pad rolls, or high temperature, atmospheric and/or pressurized steamers. These dyeing operations are time consuming, difficult to control in practice, and are therefore inefficient and costly in producing first quality dyed goods.

Accordingly, it is an object of the present invention to provide a continuous dyeing process for the coloration of fabrics made of high-modulus, high-tenacity, low-shrinkage polyamide fibers. Another object of the invention is to provide a method in which fabrics made of high-modulus, high-tenacity, low-shrinkage polyamide fibers can be economically and efficiently continously thermosol dyed with acid dyes to obtain colored fabrics with superior overall fastness properties, without having to use high temperature steamers. Another object of this invention is to provide a process in which these polyamide fabrics can be dyed under conditions and with conventional processing equipment, that does not require special modification or adjustment—equipment that is also suitable for the continuous dyeing of other textile fabrics such as polyesters and polyester blends. Other objects of the invention will become apparent from a consideration of the description which follows.

DETAILED DESCRIPTION OF THE INVENTION

The present invention relates to the surprising discovery that high-modulus, high-tenacity, low-shrinkage polyamide fiber or products made of this fiber—such as textile fabrics, previously thought of as being difficult to efficiently dye to good tinctorial values while possessing good overall fastness properties without having, for example, to dye them on dyeing machines such as jigs, beams, pad rolls, or high temperature steamers all of which are time consuming, costly and give rise to unlevel dyeing—are nonetheless capable of being continuously thermosol dyed with acid dyestuffs to produce first quality dyed fabrics free from barriness, front-to-end tailing, and other shading problems and of superior fastness and physical properties. Moreover, since the use of high temperature atmospheric or pressurized steamers is avoided by the present invention, these fabrics can now be practically and economically dyed in practice.

According to the present invention, a polyamide fabric is padded in a specially formulated cold dye pad solution and squeezed to reduce the amount of wet pickup, followed by drying and high temperature dry heat curing. The dye pad bath, formulated for even, level application, is applied to the fabric as a uniform film under ambient conditions, dried, then the color is diffused into the fibers by means of dry heat. The process may be conducted in a continuous, high speed manner using the same processing equipment used for continuously dyeing polyester fabrics, such as a thermosol dyeing range, thereby allowing another class of fabric to be dyed on existing equipment. In the procedure of this invention, the polyamide fabric does not deplete dye from the dye pad solution, hence the concentration of the dye pad solution is always constant. This way, the dyer has only to make sure that enough of the specially formulated cold dye pad solution is supplied to the pad pan to insure the full coverage of the fabric with the dye solution. The operator must also control the pad side-center-side squeeze pressure to insure uniform pickup of the dye pad solution by the fabric across its width. The high temperature curing is carried out employing dry heat "thermosoling." All these procedures are used in many current dyeing and finishing operations of the type currently used to continuously dye polyester and polyester/cellulosic blend fabrics in equipment generally known as a thermosol dyeing range. Those minor adjustments are readily accomplished by the operator and are easy for the dyer to control in practice. The cold dye pad solution used in the processing according to the present invention is capable of permeating the acid dyestuff inside the fiber and developing the true color of the dye when the padded and squeezed fabric is exposed to the action of dry heat during the drying and curing or thermosoling stages. At the end of drying and dry heat curing or thermosoling, the fabric is then cooled. Any unfixed dyes and impurities are then removed from the cured fabric by subsequent rinsing and scouring after which the fabric is finally dried.

As used in this application, a "cold" (unheated) dye pad bath is maintained at ambient temperatures during the dyeing operation; heat is not deliberately added to the dye pad bath. The term "ambient temperatures", as used in this specification and appended claims, refers to the temperature of the pad bath as it exists in the plant or facility under normal operating conditions. Operational temperatures may vary widely depending upon seasonal changes and other procedures conducted in the same facility. Temperatures as high as about 35° C. may be encountered. Since the purpose of the pad bath plus associated rollers and control devices is to apply a uniform film of the dyeing medium to the fabric, temperatures above 35° C. may cause the fabric to begin depleting the dye from the dye pad solution giving rise to front-to-end tailing and other shading problems. Curing is carried out in a thermosol heated oven employing dry heat at temperatures ranging from about 175° C. to 230° C. for the appropriate period of time which generally ranges from 1 to 6 minutes.

As used in this application, thermosoling or thermal fixation is a process of dyeing fabrics, typically polyester, in which the dyestuff is diffused and fixed inside the fiber by means of dry heat.

Accordingly, high-modulus, high-tenacity, low-shrinkage polyamide fibers and fabrics made of these fibers can now be continuously dyed in this process with acid dyes without having to use high temperature steamers, thereby providing the dyer with an efficient and economic dyeing process with a wide range of acid dyes from which to choose to color these fabrics into any color required. Fabrics dyed according to the process of this invention have outstanding overall fastness properties especially to light, washing, crocking, dry cleaning, and sublimation without adversely affecting the handle and excellent mechanical properties of these polyamide fabrics.

Acid dyestuffs are an especially preferred class of dyestuff to which the process of this invention is well suited. As a class, acid dyes exhibit excellent overall fastness properties on these high-modulus, high-tenacity low-shrinkage, polyamide fabrics. To my knowledge, acid dyestuffs have not been used in dry heat-intensive processes such as thermosoling to continuously dye high-modulus, high tenacity, low shrinkage polyamide fibers and fabrics made of these fibers. Padding under cold conditions and high temperature dry heat curing or thermosoling according to this invention permits dyeing speeds of up to 200 yards per minute to be achieved in practice, tremendously economizing the coloration of these fabrics. In addition, since this process does not require high temperature atmospheric or pressurized steaming operations to efficiently fix the acid dyestuff inside the fiber and develop the color, high-modulus, high-tenacity, low-shrinkage polyamide fibers and fabrics made of these fibers can now be efficiently and economically dyed with acid dyes in practice.

Application of the dye medium to the fabric in a pad bath, plus the constituents of the pad bath itself, as desribed in more detail below, are designed and formulated to provide a uniform film of the dye medium on the fabric and to saturate the individual fibers, including crossover points, to the extent possible. Thus, the pad bath as a whole is transferred onto the fabric and is replenished by the addition of fully formulated pad bath solution as may be required. The intent is to avoid dye(s) exhaustion into the fiber at the padding stage, and to completely penetrate and fix the acid dye(s) inside the fiber during the dry heat curing or thermosoling stage.

The cold dye pad solution of the present invention is formulated to achieve these goals and is prepared to operate under cold conditions. The dye pad solution will preferably include an organic acid, a polyethylene glycol compound, a polyoxyethylene sorbitan fatty acid ester, a polyalkylene glycol ether, an antimigrant, a thickening agent, a tinctorial amount of at least one acid dyestuff and water. Other dye pad additives such as flame retardants, UV absorbers, antistatic agents, water repellents and other finishing and processing aids may also be present in the dye pad solution. The organic acid will preferably be present in the dye pad solution in an amount between 1% to 10% weight/weight. Preferred for use in the present invention are organic acids selected from the group consisting of ethanedioic acid, propanoic acid, 2-hydroxy-1,2,3-propanetricarboxylic acid, hydroxyacetic acid, butanedioic acid and butenedioic acid, with 2,3-dihydroxy butanedioic acid being particularly preferred.

Any suitable polyethylene glycol compound of the general formula $HOCH_2(CH_2OCH_2)_nCH_2OH$ where n is an integer can be utilized in the successful practice of the invention. The polyethylene glycol compound should have a molecular weight between 400 to 8,000 and be present in the dye pad solution in an amount between 0.5 to 5.0% (weight/weight).

A non-ionic water soluble surface active agent of the polyoxethylene sorbitan fatty acid ester group of compounds is also present in an amount between 0.5 to 5.0% (weight/weight) of the dye pad solution. The fatty acid moiety of the polyoxyethylene sorbitan fatty acid ester compound can be laurate, palmitate, stearate, tristearate, oleate, or trioleate with polyoxyethylene sorbitan laurate being particularly preferred.

Additionally, a polyalkylene glycol ether in an amount between 0.2 to 2.0% (weight/weight) of the dye pad solution is present. Preferred for use in the present invention is alkoxy (poly-ethylenoxy-propylenoxy) isopropanol having a molecular weight between about 600 and about 700.

The antimigrant used is preferably a water-soluble anionic polyacrylamide polymer of very high molecular weight, over 8 million, made by polymerizing acrylamide, and will be present in an amount sufficient to minimize dye migration during the drying stage prior to the thermofixation of the dye inside the fiber.

The thickening agent can be any of the conventional thickeners used in continuous dyeing of polyester/cotton blend fabrics such as gums, natural and etherified locust bean gums, carboxymethyl cellulose, gum tragacanth, polyacrylic acid or its sodium salt, or sodium alginate. Preferably, the thickening agent used is a sodium alginate type and will be present in an amount sufficient so that the resulting pad bath has the appropriate viscosity.

Any acid or premetalized acid dyestuff which does not affect the homogeneity and stability of the dye pad solution may be used. Combinations of these dyes can also be used in the same dye pad solution at use temperatures, usually not above 35° C. By way of example, acid dyestuffs which can be used according to the present invention are listed in the following table.

| DYESTUFF | COLOR INDEX NO. |
|---|---|
| Nylomine Yellow A-2GA | C.I. Acid Yellow 49 |
| Telon Red GRL | C.I. Acid Red 392 |
| Nylomine Blue AG | C.I. Acid Blue 25 |
| Telon Fast Rubin A-5BLW | C.I. Acid Rubin 229 |
| Sulpho Flavine FF | C.I. Acid Flavine 7 |
| Sulpho Rhodamine B | C.I. Acid Rhodamine |
| Lanaperl Yellow R | C.I. Acid Yellow 25 |
| Lanaperl Yellow 3G | C.I. Acid Yellow 41 |
| Nylomine Orange C2R | C.I. Acid Orange 33 |
| Telon Red GN | C.I. Acid Red 111 |
| Nylomine Red A-2B | C.I. Acid Red 266 |
| Nylomine Red AB | C.I. Acid Red 396 |
| Nylomine Red CG | C.I. Acid Red 151 |
| Telon Red FL | C.I. Acid Red 337 |
| Telon Fast Red AFG | C.I. Acid Red 360 |
| Nylomine Green C-3G | C.I. Acid Green 28 |
| Erionyl Green GNL | C.I. Acid Green 25 |
| Levalan Violet 4BF | C.I. Acid Violet 41 |
| Telon Blue BL | C.I. Acid Blue 72 |
| Brilliant Alizarine Blue 3 FR | C.I. Acid Blue 62 |
| Acilan Blue AS | C.I. Acid Blue 27 |
| Telon Blue 2GL | C.I. Acid Blue 40 |
| Irgalan Blue 7GS | C.I. Acid Blue |
| Eriosin Blue 3G | C.I. Acid Blue 27 |
| Alizarine Blue AR | C.I. Acid Blue 41 |
| Telon Blue RRL | C.I. Acid Blue 62 |
| Lanaperl Blue B | C.I. Acid Blue 41 |
| Nylomine Blue A-G | C.I. Acid Blue 25 |

The high-modulus, high-tenacity, low-shrinkage polyamide fiber for which the process of the present invention is particularly well suited can be in any suitable structural form, i.e., light, medium and heavy weight woven and knitted fabrics of different structures constructed from flat or texturized/bulked continuous filament and spun yarns of different types and counts, non-woven, felt and carpet materials.

The term high-modulus, high-tenacity, low-shrinkage polyamide as used herein is to be understood as referring to those polycarbonamides made by the intermolecular condensation of linear diamines containing from 6 to 10 carbon atoms with the linear dicarboxylic acids containing from 2 to 10 carbon atoms.

Preferably it is a high-tenacity nylon yarn spun from poly(hexamethylene adipamide), or 6,6 nylon, which has a draw ration of at least 4.0, and preferably in the range of 4.6 to 5.1. Such fibers are disclosed in U.S. Pat. No. 3,433,008 to Gage, and are currently commercially available from various sources including Cordura® nylon and High Tenacity Nylon 66, both available from DuPont, Wilmington, Delaware. These fibers are used to make fabrics which are in turn formed into long-wearing, abrasion resistant articles of clothing, suitcase and handbag material, antiballistic clothing and protective devices and similar articles.

The currently preferred Cordura® nylon differs from ordinary nylon in that the Cordura®product contains approximately twice as many amino end-groups as conventinal nylon. Ballistic nylons and other high-tenacity nylon products may not contain an unusually high content of amino end-groups as does Cordura®, but they are also easily dyed by the process of this invention.

It is believed that the essential difference between generic 6,6 nylon and the high-tenacity nylons of concern to the present invention lies in the higher degree of structural order of these stronger nylons. The following table illustrates some of the properties of high-tenacity Cordura® nylon compared to those of ordinary nylon 6,6.

COMPARISON OF ORDINARY NYLON 6,6 WITH CORDURA NYLON

| PROPERTY | ORDINARY NYLON 6,6 | HIGH-TENACITY CORDURA NYLON |
|---|---|---|
| Amine End Groups, m-eq./kg* | 35 to 40 | 75 to 80 |
| Crystallite Orientation, relative units | 100 | 200 to 400 |
| Draw Ratio | 3 to 4 | 4 to 5 |
| $T_g$**, °C. | −5 to 1 | Higher |
| Breaking Tenacity, g/denier; | | |
| Dry | 2.5 to 6.0 | 5.9 to 9.8 |
| Wet | 2.0 to 5.5 | 5.1 to 8.0 |
| Ultimate Elongation %; | | |
| Dry | 25 to 65 | 15 to 28 |
| Wet | 30 to 70 | 18 to 32 |
| Elastic Recovery, %*** | 88 | 89 |

*Milliequivalents/kilogram
**Second-order transition temperature
***Recovery of length from 3% extension The process of the present invention can also be conveniently carried out using conventional continuous dyeing machinery and techniques. For example, the fabric can be evenly padded and squeezed in cold open width form under ambient conditions in the cold dye pad solution of this invention. The padded and squeezed fabric is dried then cured for 1 to 2 minutes or so at 200°to 230° C. utilizing dry heat under atmospheric pressure. Residual unfixed dyestuffs, thickener, antimigrant and other impurities from the dyed goods are then removed from the textile fabric by subsequent washing treatments.

DESCRIPTION OF THE PREFERRED EMBODIMENTS

The foregoing and other objects, features, and advantages of the present invention will be made more apparent by way of the following nonlimiting examples in wich the parts and percentages are reported by weight unless otherwise indicated.

EXAMPLE 1

A plain weave Cordura Nylon fabric made of 1000/140 Bright T-440 DuPont Cordura Nylon 2X warp yarn and 1000/140 Bright T-440 DuPont Cordura Nylon fill yarn weighing 97.6 lbs./100 cloth yards (typically used to make duffle bags, backpacks, boots, coated fabrics, protective fabrics, golf bags, luggage, shoes, protective covers, ski covers/boot bags, and garments offering protection against extreme mechanical forces) was padded and evenly squeezed in open-width form to about 80% pick up under ambient temperatures, in a cold (unheated) 27° C. dye pad solution having the following composition;

| | Parts |
|---|---|
| Nylomine Yellow A-2GA (C.I. Acid Yellow 49) | 30.0 |
| 7% aqueous solution of Polygum 273 | 160.0 |
| 2,3-dihydroxybutanedioic Acid | 30.0 |
| Polyethylene glycol (M.W. 400) | 21.0 |

-continued

| | Parts |
|---|---|
| Polyoxyethylene Sorbitan Laurate | 21.0 |
| Alkoxy (polyethylenoxypropylenoxy) Isopropanol (M.W. 640) | 8.0 |
| Separan AP 273 (Dow Chemical Company - Polyacrylamide Polymer mol. Wt. over 10 × $10^6$) | 0.1 |
| Water | 729.9 |
| | 1000.0 |

The fabric was then dried at 148° C. for 2 minutes, and subsequently dry heat cured in an oven for two minutes at 216° C. under atmospheric pressure. The cured fabric was then rinsed in cold and hot water, treated for 5 minutes in an aqueous solution containing 0.5% sodium carbonate and 0.2% of a non-ionic detergent at 80° C., rinsed in hot water followed by cold water, and finally dried. A yellow dyed fabric having good overall fastness properties to light, washing and crocking was obtained. A cross-section photomicrograph of the dyed fibers revealed that the dyestuff molecules were completely penetrated and fixed inside the fiber.

EXAMPLES 2–8

The procedures of Example 1 were repeated using the following dyestuffs in the dye pad solutions:

| | | |
|---|---|---|
| EXAMPLE 2: | Telon Red GRL (C.I. Acid Red 392) | 30 Parts |
| EXAMPLE 3: | Nylomine Blue AG (C.I. Acid Blue 25) | 30 Parts |
| EXAMPLE 4: | Telon Fast Rubine A-5BLW (C.I. Acid Red 229) | 30 Parts |
| EXAMPLE 5: | Sulpho Flavine FF (C.I. Acid Yellow 7) | 30 Parts |
| EXAMPLE 6: | Sulpho Rhodamine B (C.I. Acid Red 52) | 30 Parts |
| EXAMPLE 7: | Lanaperl Yellow R (C.I. Acid Yellow 25) | 30 Parts |
| EXAMPLE 8: | Nylomine Blue AG | 11.5 Parts |
| | Nylomine Yellow A-2GA | 16.8 Parts |
| | Telon Red GRL | 1.2 Parts |

Red (Example 2), Blue (Example 3), Maroon (Example 4), Yellow (Example 5), Red (Example 6), Yellow (Example 7), and Olive Green (Example 8), uniformly dyed fabrics having good overall fastness properties with complete dye penetration inside the fiber were respectively obtained.

Red (Example 2), Blue (Example 3), Maroon (Example 4), Yellow (Example 5), Red (Example 6), Yellow (Example 7), and Olive Green (Example 8), uniformly dyed fabrics having good overall fastness properties with complete dye penetration inside the fiber were respectively obtained.

What is claimed is:

1. A process for the continuous dyeing of fabrics constructed of high-modulus, high-tenacity low-shrinkage Polyamide fibers with acid dyes comprising the successive steps of:

(a) padding polyamide fabric in open width form in a pad bath solution maintained at a temperature not greater than about 35° C., the pad bath solution applied to the fabric as a uniform film and consisting essentially of a thickening agent, an antimigrant, an organic acid, a polyethylene glycol compound, a polyoxyethylene sorbitan fatty acid ester, a polyalkylene glycol ether, at least one acid dyestuff, and water;

(b) drying and curing the thus padded fabric under dry conditions at an elevated temperature and for a time sufficient to permeate and fix the dyestuff molecules inside the polyamide fibers, and (c) rinsing and washing the thus cured fabric to remove any residual unfixed dye or other water-soluble components from the fabric.

2. The process of claim 1 in which the fabric is padded in a pad bath solution at a temperature of about 20° C. to about 35° C.

3. The process of claim 1 in which the fabric is cured in step (b) at a temperature in the range of about 150° C. to 230° C. in a dry heat oven.

4. The process of claim 3 in which the fabric is dried and cured for a period of about 2 to about 8 minutes.

5. The process of claim 1 in which the textile fabric is composed entirely of high-modulus, high-tenacity, low shrinkage polyamide fibers.

6. The process of claim 1 in which the organic acid is selected from the group consisting of ethanedioic acid, 2,3-dihydroxybutanedioic acid, 2-hydroxy-1,2,3-propanetricarboxylic acid, hydroxyacetic acid, propanoic acid, butanedioic acid, butenedioic acid or mixtures thereof.

7. The process of claim 6 in which the organic acid is present in an amount of from about 1% to about 10% w/w.

8. The process of claim 6 in which the organic acid is 2,3,-dihydroxybutanedioic acid.

9. The process of claim 1 in which the polyethylene glycol compound has a molecular weight between about 400 and about 8,000.

10. The process of claim 9 in which the polyethylene glycol compound is present in an amount from about 0.5% to about 5.0% w/w.

11. The process of claim 1 in which the polyalkylene glycol ether is alkoxy (polyethylenoxypropylenoxy) isopropanol having a molecular weight between about 600 and about 700.

12. The process of claim 1 in which the polyalkylene glycol ether is present in an amount of from about 0.2% to about 2.0% w/w.

13. The process of claim 1 in which the polyoxyethylene sorbitan fatty acid ester is a laurate, palmitate, stearate, tristearate, oleate, or trioleate.

14. The process of claim 13 in which the ester is polyoxyethylene sorbitan laurate.

15. The process of claim 1 in which the polyoxyethylene sorbitan fatty acid ester is present in an amount between about 0.5 and about 5.0% w/w.

16. The process of claim 1 in which the antimigrant agent is composed of a very high-molecular weight synthetic water-soluble anionic polyacrylamide polymer.

17. The process of claim 1 in which the pad bath solution contains at least one organic acid dyestuff which is soluble in and compatible with the pad bath solution.

18. A process for continuously dyeing fabrics constructed of high-modulus, high-tenacity low-shrinkage nylon 6,6 fibers comprising the successive steps of:

(1) applying to the nylon 6,6 fabric in open width a uniform film of a pad bath solution maintained at a temperature not greater than about 35° C., the pad bath solution consisting essentially, in percent by weight of the solution, of:

(a) a thickening agent;

(b) from about 1% to 10% of an organic acid selected from the group consisting of ethanedioic acid, 2,3-dihydroxybutanedioic acid, 2-hydroxy- 1,2,3-propanetricarboxylic acid, hydroxyacetic acid, propanoic acid, butanedioic acid, butenedioic acid, and mixtures thereof;

(c) an antimigrant agent;

(d) from about 0.5% to about 5.0% of a polyethylene glycol having a molecular weight between about 400 and about 8,000;

(e) from about 0.5% to about 5.0% of a polyoxyethylene sorbitan fatty acid ester in wich the residue of the fatty acid moiety is derived from lauric acid, palamitic acid, stearic acid, or oleic acid;

(f) from about 0.2% to about 2.0% of a polyalkylene glycol ether having a molecular weight between about 600 and about 700;

(g) a tinctorial amount of at least one acid dyestuff that is soluble in and compatible with the pad bath solution;

(2) drying and thus padded fabric;

(3) dry heat curing or thermosoling the dried fabric in an oven at an elevated temperature at atmospheric condition or under pressure, for a time sufficient to permeate and fix the dyestuff molecules inside the polyamide fibers; and (4) washing and rinsing the thus treated fabric to remove any unfixed dye or water soluble components from the fabric.

* * * * *